United States Patent [19]

Helinski

[11] 4,212,550

[45] Jul. 15, 1980

[54] RIBBON STORAGE MECHANISM HAVING ECCENTRICALLY MOUNTED FEEDING ELEMENTS

[75] Inventor: Edward F. Helinski, Johnson City, N.Y.

[73] Assignee: International Business Machines Corporation, Armonk, N.Y.

[21] Appl. No.: 924,462

[22] Filed: Jul. 14, 1978

[51] Int. Cl.[2] ..... B41J 33/10

[52] U.S. Cl. ..... 400/196.1; 400/235.1

[58] Field of Search ..... 400/194, 195, 196, 196.1, 400/235, 235.1, 641

[56] References Cited

U.S. PATENT DOCUMENTS

| | | | |
|---|---|---|---|
| 2,685,357 | 8/1954 | Koreska | 400/196.1 |
| 3,411,686 | 11/1968 | Bender | 400/235.1 X |
| 3,814,231 | 6/1974 | Cappotto | 400/196.1 X |
| 3,871,507 | 3/1975 | Perry et al. | 400/196.1 X |
| 3,974,906 | 8/1976 | Lee et al. | 400/568 X |
| 3,989,132 | 11/1976 | Carson | 400/196.1 X |
| 4,053,040 | 10/1977 | McGourty | 400/196.1 X |
| 4,084,503 | 4/1978 | Pylant et al. | 400/641 X |

FOREIGN PATENT DOCUMENTS

| | | | |
|---|---|---|---|
| 53-109711 | 9/1978 | Japan | 400/235.1 |
| 53-123216 | 10/1978 | Japan | 400/235.1 |

*Primary Examiner*—Ernest T. Wright, Jr.
*Attorney, Agent, or Firm*—Kenneth P. Johnson

[57] ABSTRACT

Apparatus for packing ribbon into a storage compartment in regular, uniform pleats. A pair of eccentric rotating feed rolls form a nip gripping the ribbon and alternately extend peripheral portions into the storage compartment beyond fixed stripping elements on opposite sides of the nip to form the ribbon in corresponding folds. The regular folding provides efficient storage and uniform compaction pressures, and permits reliable ribbon withdrawal when the storage compartment is used for an endless ribbon.

15 Claims, 11 Drawing Figures

RIBBON STORAGE MECHANISM HAVING ECCENTRICALLY MOUNTED FEEDING ELEMENTS

BACKGROUND OF THE INVENTION

This invention relates generally to ribbon storage devices and more particulary to apparatus for producing uniform ribbon pleats within the storage compartment.

Cartridges for storing inked ribbon in random pleats or folds are well known. The ribbon is often an endless loop that is being concurrently stored and withdrawn. Usually the ribbon is forced or stuffed into the cartridge storage compartment by a pair of feed rolls frictionally gripping the ribbon so that the ribbon forms random bights or folds. No attempt is made to guide or position the pleats which, as a result, are randomly directed within the storage compartment by the impedance and pressures of previously stored ribbon.

Because of the randomness, the ribbon does not progress uniformly through the compartment but rather forms in clumps of folds. These clumps are tied in a meander and often become entrapped behind later-formed ones. Significantly varying withdrawal tension then results. This randomness also results in compaction pressures which vary over a wide range, and create low density storage pockets within the compartment, resulting in inefficient use of the storage volume. At times entanglements occur which even require premature discard of the cartridge.

Because of the wide variation in compaction pressures resulting from randomly plicated ribbon, storage compartments are usually formed with increasing cross-sectional area as the ribbon leaves the feed rolls to relieve compaction pressure. This technique has been used to decrease the withdrawal tension required and to make the tension more uniform. Thus, the irregular configuration of the storage compartment adds to the deficiences previously mentioned.

A previous effort to provide for the storage of uniform ribbon plicae within a compartment is shown in U.S. Pat. No. 2,685,357. This patent describes various techniques of including reciprocating guide elements within the compartment to form the bights uniformly across the chamber. Cranks or gear and rack are used to operate the necessary guiding pins within the compartment. Although the patented apparatus accomplishes highly efficient and desirable ribbon storage, the added structure to perform the packing increases the cost.

In U.S. Pat. No. 3,871,507, no attempt is made to produce uniform pleats in the ribbon, but there is disclosed structure for clearing the ribbon as it leaves the feed rolls and thereby to induce improved packing of the ribbon within the chamber. This is accomplished by using eccentrics to alternately move each of a pair of stripping fingers to push the ribbon from the feed roll surfaces.

Other U.S. Pat. Nos. ilustrative of the random, irregular stuffing of ribbons into storage chambers are 4,053,040; 3,989,132 and 3,814,231. No sturcture is shown in these disclosures that is capable of producing ribbon plicae having uniform length and which are stored in an ordered arrangement.

OBJECTS AND SUMMARY OF THE INVENTION

Accordingly, it is a primary object of this invention to provide feed roll apparatus for forcing a flexible web, such as an ink ribbon, into a storage compartment in regular, ordered folds without the necessity of supplemental guiding structure within the compartment.

Another object of this invention is to produce regular, ordered folds of a flexible web in a storage compartment by a pair of inexpensive rotatable elements which alternately extend into the chamber to position a portion of each web plait.

Yet another object of this invention is to provide apparatus for accomplishing regular uniform folds within a storage chamber to provide an even compaction pressure within the chamber and ordered location of the web pleats to permit withdrawal under a more constant tension and to improve the packing efficiency of the web within the compartment.

A still further object of this invention is to provide feed roll apparatus for stuffing a flexible web into a storage compartment for forming uniform, ordered plaits each having a length dependent upon the eccentricity or size of the feed roll.

The present invention attains the foregoing objects by providing a pair of rotatable, eccentrically mounted feed rolls, each cooperating with a respective fixed stripping element to alternately and frictionally urge engaged web portions to opposite sides of a chamber in which the web is to be stored. A nip for gripping the incoming web is formed by the two feed rolls and operable to continually force the web toward the chamber while a frictional surface of the feed roll extending beyond a stripping means is operable to carry the web with it until the feed roll eccentricity causes it to recede behind its respective stripping element. The mating eccentric feed roll then begins to extend a peripheral surface beyond its respective stripping element and carry the web in the opposite direction until it, too, recedes behind the surface of its stripping element. The first feed roll is then operable to form a new fold.

The disclosed apparatus can be modified to provide folds of different length within the storage compartment by altering either the diameter of the feed rolls, the number of web carrying lobes extending beyond each stripping element during a cycle or the dimensions of the stripping elements. In addition, only a single feed roll needs to be positively driven allowing the other to be an idler pivotable away from the driven roll to permit the insertion of a web and accommodate the eccentricity. The invention can be readily constructed to be a portion of the storage compartment or separately structured to be used with a plurality of chambers.

DESCRIPTION OF THE PREFERRED EMBODIMENTS

Figure 1:
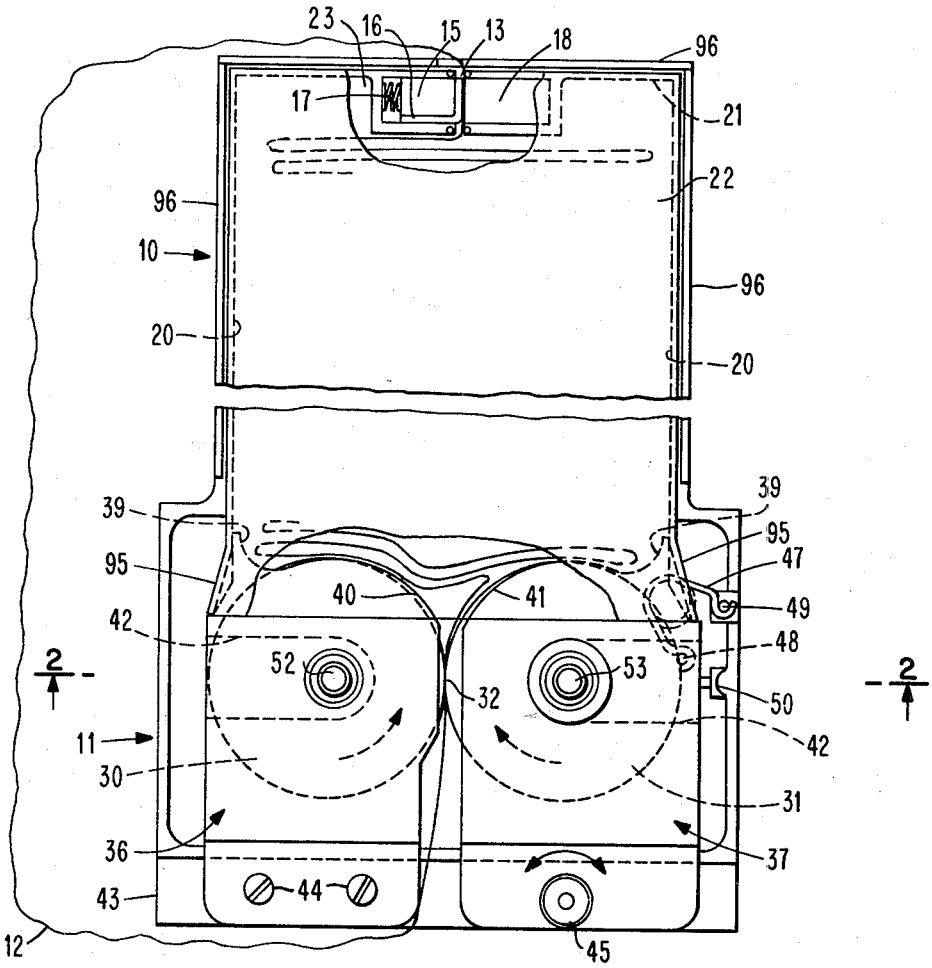
FIG. 1 is a plan view of an ink ribbon cartridge incorporating feed rolls and stripping elements arranged in accordance with the invention for packing ribbon into the cartridge.
Figure 2:
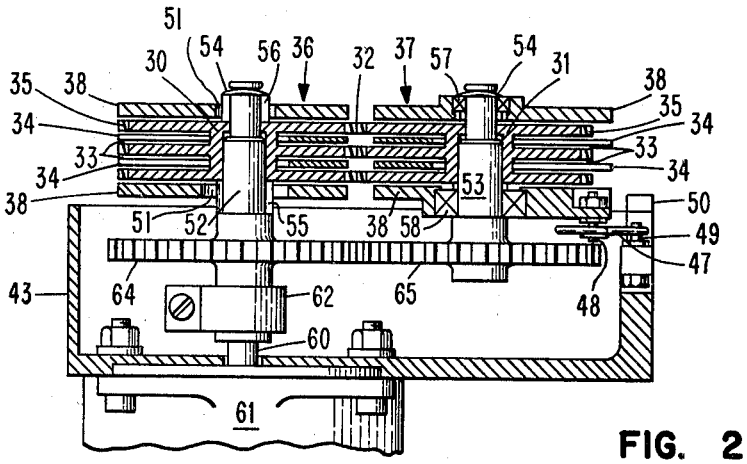
FIG. 2 is a sectional view of the cartridge taken along the line 2—2 of FIG. 1.

Referring to FIGS. 1 and 2, the invention is illustrated as an ink ribbon cartridge comprising generally a storage compartment 10 for a plicated web 12 such as a ribbon, and a packing mechanism 11 for forcing the ribbon 12 into the storage compartment 10. Ribbon 12 is shown as an endless loop in this embodiment and is withdrawn from compartment 10 at an exit 13 past a frictional restraint which is shown as plunger 15 having a layer of friction material 16 thereon, which assembly is urged by spring 17 toward a fixed block 18 on the opposite side of the ribbon 12. The storage compartment 10 is generally rectangular, having a width approximating the span of the ribbon plicae and arbitrary length, and is formed with side walls 20, end wall 21, top cover 22 and bottom cover 23.

Packing mechanism 11, for forcing the ribbon 12 into storage compartment 10, comprises a pair of feed rolls 30, 31 rotatable in contact with each other to form a nip at 32 to grip the ribbon 12. Each feed roll 30, 31 is relieved at aligned locations 33 to provide for the interleaving of stripping elements or fins 34. The two feed rolls 30, 31 each have a high friction surface or coating of material 35, such as urethane or butyl rubber, on their peripheries to maintain a driving force to urge the ribbon 12 into a pleat within the storage compartment 10.

Stripping means are provided to insure that the compacted ribbon 12 does not adhere to the surfaces 35 of the feed rolls 30, 31 during compaction. Each feed roll 30 and 31 is thus provided with a respective stripping device 36 and 37, each of which is a comb-like member having interior fins 34, mentioned above, and exterior top and bottom fins 38. Each stripping device 36, 37 is preferably molded and is formed with a respective radius 40 and 41 within compartment 10 similar to the radius of the feed rolls 30, 31. The fins 34 are supported by integrally molded columns 39. The stripping devices 36, 37 are each formed with a recess 42 in the pair of interior fins 34 for the purpose of assembling the respective feed rolls 30, 31 therein. Stripping device 36 is secured to base 43 by suitable means such as screws 44, while stripping device 37 is pivotally mounted on the base 43 at stud 45 and is rotatable about the stud 45. Stripping device 37 and its feed roll 31 are urged counterclockwise toward feed roll 30 about the pivot 45 by a torsion spring 47 secured at pin 48 on device 37 and pin 49 on base 43. Spring 47 and pins 48, 49 are located so as to form a toggle arrangement when stripping device 37 is manually rotated clockwise with its feed roll 31. This action makes it convenient for inserting ribbon 12 between the two feed rolls 30, 31. Device 37 engages stop 50 on the base when in the open position.

The two feed rolls 30, 31 are assembled with respective stripping devices 36 and 37 by placement within the respective cutouts 42 and thereafter having respective shafts 52 and 53 inserted therein and retained with clips 54. Shaft 52 has a collar 55 which maintains feed roll 30 at the proper elevation. Stripping comb 36 is provided with clearance openings 51 for the shaft 52 and a collar 56 in the top fin 38, and shaft 52 in the bottom fin 38. Shaft 53 supporting feed roll 31 is mounted in bearings 57 and 58 within stripping comb 37. It should be noted that feed roll 30 can be rotatably supported by stripping device 36, if desired. The motor shaft and feed roll shaft alignment then becomes more critical. Shaft 52 is connected to the drive shaft 60 of a suitable motor 61, such as a stepping motor, by means of a clamp 62. Shaft 52 has fixed thereto spur gear 64 which engages spur gear 65 on shaft 53. Motor 61 thus directly drives feed roll 30 and spur gear 64, which drives spur gear 65 and feed roll 31. The teeth of the two spur gears 64, 65 are of sufficient length so that they are continually intermeshed to maintain a fixed relationship even when stripping comb 37 and its feed roll 31 are rotated against stop 50 for insertion of ribbon 12.

As mentioned above, feed rolls 30 and 31 are eccentrically mounted on their respective supporting shafts 52 and 53. The two feed rolls 30, 31 are initially assembled so that the high point of one feed roll and low point of the other are in contact at nip 32. The spur gears 64, 65 for each feed roll 30, 31 will insure that this relationship is maintained during operation. Other means for positively maintaining the relationship may also be used. In the position shown, nip 32 will reciprocate between the two stripping combs 36 and 37 a distance equal to the amount of eccentricity, which is preferably the same for each feed roll 30, 31.

During the rotation of the feed rolls 30, 31 in the direction of the dashed arrows, the high point of feed roll 31 presently at nip 32, will move up (FIG. 1) and outwardly away from radius 41 into storage compartment 10. Simultaneously the low point of feed roll 30 presently at nip 32 will move up and retract from the edge of radius 40 so that it no longer is effective to engage and drive the ribbon 12 to the left. The inherent stiffness of the ribbon 12 will then permit it to be pushed more directly into the storage compartment 10 and force it to move toward and follow the periphery of feed roll 31. Since the periphery of feed roll 31 is moving outwardly away from radius 41, the surface 35 of the feed roll 31 is effective to carry the ribbon 12 over to the right and form another pleat. The length of the pleat is determined by the linear distance that the periphery of feed roll 31 remains in contact with the ribbon 12 in storage compartment 10 beyond radius 41 of the stripping device 37.

Figure 3A:
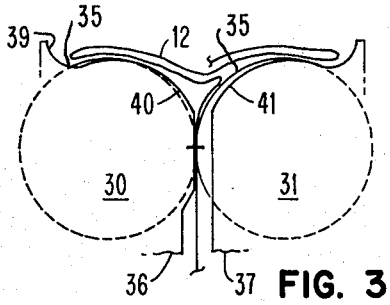
FIGS. 3*a*–3*e* are schematic diagrams illustating the formation of a ribbon pleat during the progressive rotation of feed rolls shown in FIG. 1.

The progressive development of a plica with this invention is more clearly illustrated in FIGS. 3*a*–3*e*. Feed rolls 30 and 31 and stripping devices 36 and 37 are schematically shown in FIG. 3*a* as they are positioned in FIG. 1. The original contact point of each feed roll at nip 32 is indicated by a short mark to illustrate the comparative travel as feed roll rotation progresses for each 45 degrees. It will be seen that feed roll 30 has receded below radius 40 in 45 degrees of travel and is not effective to pull ribbon 12 to the left. Thus, continued feeding of the ribbon 12 by rotation of the feed rolls 30, 31 causes a blousing to occur in the relatively open area between the feed rolls 30, 31. The inherent stiffness of the ribbon 12 is sufficient to force the forming loop toward feed roll 31.

Figure 3B:
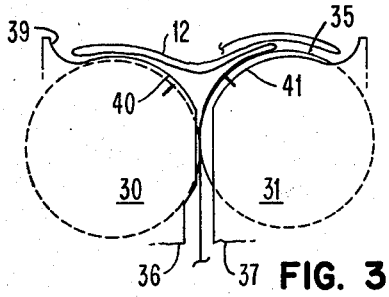
Figure 3C:
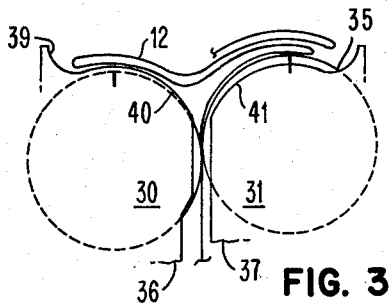
Figure 3D:
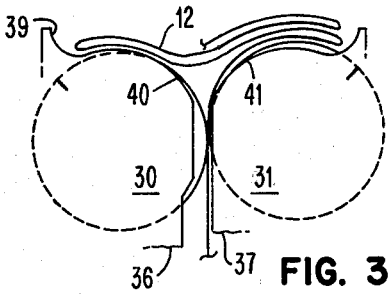
Figure 3E:
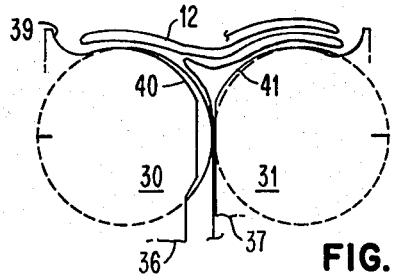

In FIG. 3*b*, it will seen that after 45 degrees of rotation, the forming plica is nearly coincident with the feed roll travel. Feed roll 31 is engaging and pushing ribbon 12 into the storage compartment 10 so that the ribbon 12 follows on the feed roll periphery toward the forming bight. In FIG. 3*c*, after 90 degrees of rotation, the new ribbon loop is progressing toward its limit on the right at half the peripheral velocity of roll 31 and the periphery of feed roll 31 is at its maximum projection and is now starting to recede, although it still extends into the storage compartment 10. After 135 degrees of rotation in FIG. 3*d*, feed roll 31 is now about to recede behind radius 41 of stripping device 37 and is no longer effective to pull incoming ribbon 12 to the right. In FIG. 3e, after 135 degrees of rotation, the ribbon 12 starts to blouse in the open area in the opposite direction toward feed roll 30 in preparation for forming a bight at the opposite side. Roll 30 is beginning to extend into the storage compartment 10.

Although there is no contact between the ribbon 12 and a feed roll surface 35 momentarily during the transition, the inherent stiffness of the ribbon 12 or web initiates a loop in the open, low pressure area and blouses in the opposite direction. The currently effective feed roll surface 35 is thus able to continue ribbon 12 feeding and draw the ribbon 12 to the full width of the plicae.

This invention of using alternately effective feed roll surfaces 35 enables the formation of uniformly folded ribbon 12 in a storage compartment 10 and achieves a more efficent compaction of ribbon 12 within the allotted storage. Ribbon tension during withdrawal is much less varied and more reliable, since the tendency of random, disordered clumps of ribbon pleats is eliminated.

Figure 4:
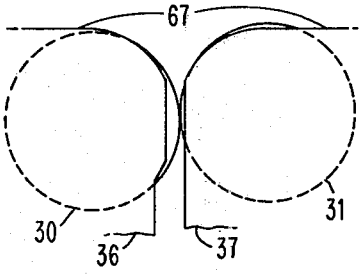
FIGS. 4 through 7 are each an alternative embodiment of a ribbon packing device incorporating the principles of the invention.
Figure 5:
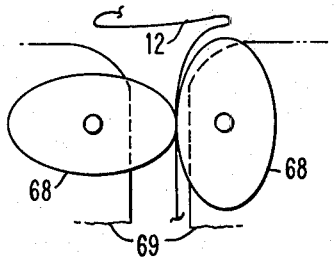

It will be apparent from the foregoing description that the duration of exposed and effective feed roll surface within the storage compartment 10 during rotation is determinative of the loop length in packing ribbon 12 within the compartment 10. It thus follows that the length of plicae can be varied by changing the diameter or peripheral configuration of the feed rolls 30, 31. Also, as in FIG. 4, the configuration of the stripping device edges 67 can be modified to extend or limit the availability of friction surface 35 in pulling or packing the ribbon 12. From FIG. 5, it will be further noted that eliptical feed roll 68 can be employed with the cooperating stripping device 69 to form twice the number of loops during a revolution of the feed roll 68. These loops, however, will be smaller in length because of the shorter distance over which a driving feed roll surface is in contact with the ribbon 12.

Figure 6:
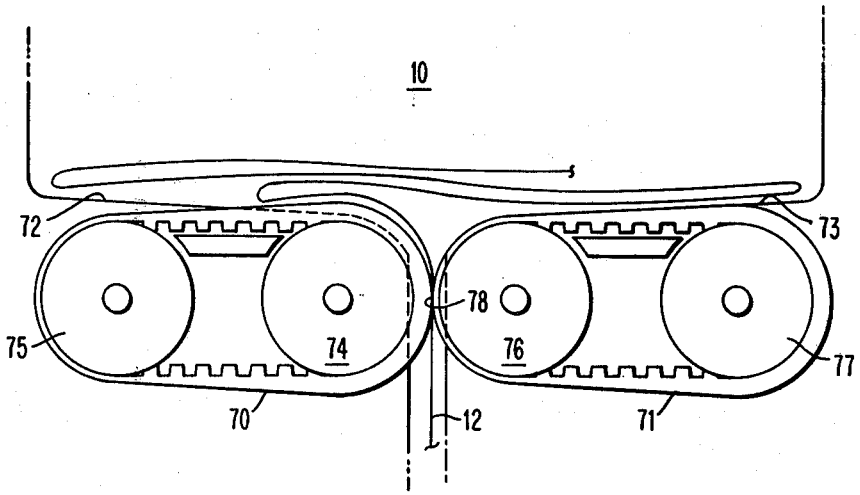

Another modification of the web packing apparatus is shown in FIG. 6. In this embodiment, belts 70, 71 of varying thickness are synchronized to alternate with each other in moving into the storage compartment 10 carrying the web 12 therewith. In this embodiment, the stripping device edges 72 and 73 extend at a gradual angle from the entry point of the web 12 toward opposite sides of the compartment 10 at the same angle as the peripheral surface of the belt 70, 71 bears with respect to the inner periphery from the thinnest point toward the thickest. Each belt 70, 71 serves as a feed element, and belt 70 is supported on driven gear 74 and idler 75. Belt 71 is supported on a pair of idlers 76, 77 which are in turn supported on a base, not shown, but similar to stripping device 37 in FIG. 1 that is spring-biased toward belt 70 to form a nip 78 to grip the incoming web 12. Idler 76 is maintained in synchronism with pulley 74 by meshing gears, not shown similar to gears 64, 65 in FIG. 1. As pulley 74 is rotated by a motor, for instance, the increasing thickness of the belt 70 moves into the compartment area with respect to stripping edge 72 and carries the web 12 with it. On the other hand, the opposite belt 71 is receding from the edge 73 of the stripping device and is no longer effective to move the web 12.

It is evident that the point of intersection between the projecting portion of the belt 70 and stripping edge 72 as the belt 70 is rotated can be made to move at one-half of the peripheral velocity of the belt 70. Also, by varying the angle of the stripping edge 72 with relation to the belt 70, the intersection of the belt 70 and stripping edge 72 can be made to move at different velocities. The web bight, of course, will move at half the velocity of the belt periphery.

Figure 7:
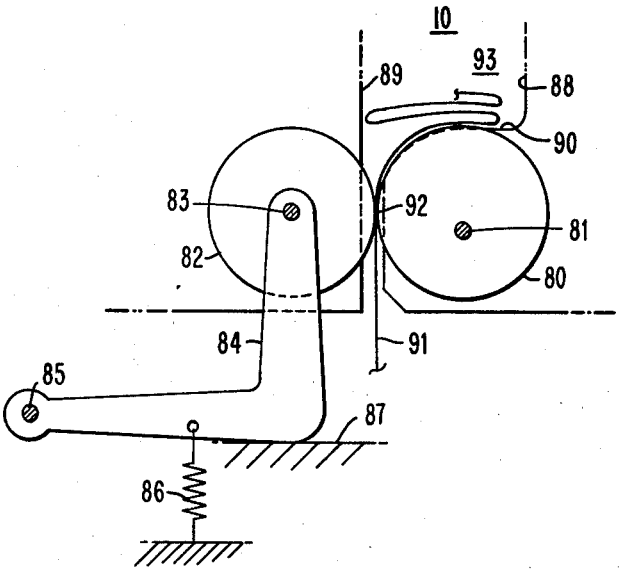

A further modification of the web packing apparatus of the invention is shown in FIG. 7. In this embodiment, web packing is accomplished by a single eccentrically mounted member. Eccentric 80 is a driven feed roll rotatable about axis 81 and cooperates with idler 82 rotatable on its axis 83 which is, in turn, supported on bell crank 84 pivotable about point 85.

A spring 86 urges idler 82 toward eccentric 80 but is limited in its travel by fixed stop 87. The storage compartment 10 is formed with walls 88 and 89 and eccentric 80 cooperates with stripping device 90 to form the plicae. The stripping device 90 may be formed as a comb similar to that in FIG. 2, and likewise the feed roll 80 may be formed with recesses mating with the comb elements of the stripping device.

In operation, a web 91 to be packed is gripped at nip 92 between eccentric 80 and idler 82 to be carried into storage compartment 93. During the time that the peripheral portion of eccentric 80 extends beyond stripping device 90, the web 12 will be carried toward the right toward wall 88. As the eccentric periphery recedes behind the surface of stripping device 90, the web 12 blouses or buckles to the left toward wall 89 briefly, but concurrently therewith the surface of the eccentric roll 80 at nip 92 moves away from idler 82 so that no further web feeding is accomplished. The idler 82 is restricted in its movement to the right by stop 87. Hence, no driving of the web 12 occurs until eccentric 80 has rotated sufficiently to again engage idler 82. The eccentricity is arranged so that the nip 92 is effective to move the web 12 a short period before the driven eccentric 80 begins to extend its high dwell portion into the storage compartment 10 and draw the web 12 again to the right. In contrast to the apparatus shown in FIGS. 1 and 2, eccentric 80 and idler 82 need not be maintained in synchronism, since the idler 82 is concentrically mounted.

The apparatus described in FIGS. 1 and 2 can be constructed so as to permit the separation of storage compartment 10 from the packing apparatus 11. This is accomplished by constructing the storage compartment 10 as an open end enclosure with the flanges 95 as shown which encompass feed rolls 30 and 31. The base 43 is formed with a low ledge 96 to retain the storage compartment 10 in position. In addition, there may be provided spring-biased retainers, not shown, on the removable storage compartment so that when the compartment is withdrawn they move in front of the compacted ribbon 12 to prevent its expansion from the open side of the storage compartment 10.

It will be noted from the foregoing description that the time during which the web feeding means extends beyond the stripping means into storage compartment can be varied in design to provide plicae of different lengths. The variation, of course, can be accomplished by altering the amount of eccentricity and size of the feed rolls, configuration of the feeding devices employed, or the configuration of the stripping devices used in cooperation with the feeding devices. Further, the surface of the feeding devices may be roughened or toothed according to the web surface smoothness instead of using the high friction material, as mentioned above. It should be noted that the invention is not restricted to packing of ink ribbons but may be adapted to other web materials. In initially packing an endless ink ribbon, for example, the storage compartment can be threaded with the ribbon running from the feed roll nip through the storage compartment and its exit and then the compaction mechanism started. The device will form regular folds eventually as the compartment fills.

While the invention has been particularly shown and described with reference to preferred embodiments thereof, it will be understood by those skilled in the art that the foregoing and other changes in form and details may be made therein without departing from the spirit and scope of the invention.

Having thus described my invention, what I claim as new, and desire to secure by Letters Patent is:

1. Apparatus for packing a web into a storage compartment comprising:

at least one stripping means having a stripping edge adjacent said compartment;

feed means for gripping said web and moving said web into said compartment, said feed means including at least one member movable with respect to said edge and alternately extending a perimetric portion beyond said edge into said compartment and receding therefrom.

2. Apparatus as described in claim 1 wherein said feed means includes a pair of feed elements intermittently engageable with each other to form a nip for gripping and drawing said web into said compartment.

3. Apparatus for packing a web in a storage compartment comprising:

a pair of stripping means, each having a stripping edge adjacent said compartment;

a feed element for each of said stripping means, said elements being movable with respect to said stripping means for gripping a web therebetween and arranged relative to said respective stripping means for alternately extending a perimetric portion beyond said edge into said compartment and withdrawing therefrom.

4. Apparatus as described in claim 3 wherein said two feed elements are synchronized with each other so that when one said element is in said extended position the other is in said withdrawn position.

5. Apparatus as described in claim 3 wherein said feed elements are non-circular in shape, having high and low parimetric dwells and further including means for moving said elements in synchronization with a high dwell of one said feed element cooperating with the low dwell of the other said feed element to grip said web and alternately extend portions of said element peripheries into said storage compartment and withdraw therefrom.

6. Apparatus as described in claim 3 wherein each said feed element is a flexible belt.

7. Apparatus as described in claim 6 wherein each said belt has a variable thickness and said two belts are synchronized to rotate in contact with each other to form a nip to grip said web, with the thickest portion of said belt cyclically engaging the thinnest portion of the other at said nip.

8. Apparatus for packing a web into a storage compartment comprising:

a pair of stripping means, each having a stripping edge adjacent said compartment;

a feed roll for each of said stripping means, each said feed roll being rotatable to form a nip with the other said roll for gripping a web therebetween, and each said roll being arranged relative to its respective stripping means for alternately extending a peripheral portion beyond said edge into said compartment and retracting behind said edge away from said compartment.

9. Apparatus as described in claim 8 wherein one of said rolls is in said extended position when said other roll is in said retracted position.

10. Apparatus as described in claim 8 further including a rotatable shaft supporting each said feed roll and wherein each feed roll is eccentrically mounted on its respective shaft for rotation therewith.

11. Apparatus as described in claim 8 wherein said stripping edges each have a perimetrical portion adjacent said compartment having a radius equal to the radius of the respective one of said feed rolls.

12. Apparatus as described in claim 8 wherein one said feed roll is movable with respect to the other to form an opening for insertion of a said web therebetween.

13. Apparatus as described in claim 8 wherein at least one of said stripping means supports a said feed roll for rotation relative thereto.

14. Apparatus as described in claim 13 wherein said at least one stripping means is movable with respect to the other of said stripping means.

15. Apparatus as described in claim 8 wherein each said feed roll has at least one recess in its periphery for insertion of a member of said stripping means therein.

* * * * *